US008122961B2

(12) United States Patent
Hill et al.

(10) Patent No.: US 8,122,961 B2
(45) Date of Patent: Feb. 28, 2012

(54) APPARATUS AND METHOD FOR DISCHARGING MULTIPLE FLUIDS DOWNHOLE

(75) Inventors: Freeman L. Hill, Houston, TX (US); Randall L. Evans, Sugarland, TX (US)

(73) Assignee: Baker Hughes Incorporated, Houston, TX (US)

( * ) Notice: Subject to any disclaimer, the term of this patent is extended or adjusted under 35 U.S.C. 154(b) by 363 days.

(21) Appl. No.: 12/428,842

(22) Filed: Apr. 23, 2009

(65) Prior Publication Data

US 2009/0266546 A1 Oct. 29, 2009

Related U.S. Application Data

(60) Provisional application No. 61/047,633, filed on Apr. 24, 2008.

(51) Int. Cl.
*E21B 43/16* (2006.01)

(52) U.S. Cl. ..... 166/305.1; 166/90.1

(58) Field of Classification Search ..... 166/305.1, 166/307, 90.1, 162
See application file for complete search history.

(56) References Cited

U.S. PATENT DOCUMENTS

| | | | | |
|---|---|---|---|---|
| 3,489,394 | A * | 1/1970 | Labyer et al. | 166/305.1 |
| 4,696,343 | A | 9/1987 | Anderson et al. | |
| 4,739,829 | A | 4/1988 | Brunner | |
| 5,392,856 | A | 2/1995 | Broussard, Jr. et al. | |
| 6,745,838 | B2 * | 6/2004 | Watson | 166/310 |
| 7,287,591 | B2 | 10/2007 | Campbell | |
| 2004/0084186 | A1 * | 5/2004 | Allison | 166/305.1 |
| 2008/0219869 | A1 * | 9/2008 | Fisher et al. | 417/545 |
| 2009/0266546 | A1 * | 10/2009 | Hill et al. | 166/305.1 |

* cited by examiner

*Primary Examiner* — William P Neuder
(74) *Attorney, Agent, or Firm* — Cantor Colburn LLP

(57) ABSTRACT

An apparatus and a method are provided for discharging a plurality of fluids downhole. In one aspect, the apparatus may include a first chamber and a second chamber separated by movable barrier, wherein draining the fluid from the first chamber causes the barrier to move and allow an actuating member to drain the second fluid from the second chamber.

20 Claims, 2 Drawing Sheets

APPARATUS AND METHOD FOR DISCHARGING MULTIPLE FLUIDS DOWNHOLE

CROSS-REFERENCE TO RELATED APPLICATION

This application takes priority from U.S. Provisional Application Ser. No. 61/047,633, filed on Apr. 24, 2008, which application is hereby incorporated by reference in its entirety.

BACKGROUND INFORMATION

1. Field of the Disclosure

The disclosure herein relates to apparatus and methods for discharging multiple fluids downhole.

2. Description of the Related Art

Oil wells (also referred to as wellbores or boreholes) are drilled into subsurface formations to produce hydrocarbons (oil and gas). Various operations are performed in the wellbore to make it ready for production of hydrocarbons therethrough. These operations include logging the formations surrounding the wellbore utilizing a variety of sensors, withdrawing fluid samples from the formations at different depths and analyzing such samples to estimate the properties of the reservoir and the fluid, perforating the formation, completing the wellbore with production equipment, etc.

Often, it is desired to discharge different fluids, such as chemicals, at one or more depths in the wellbore. Such fluids are typically discharged at the desired depths utilizing an apparatus that can carry one fluid. Use of such apparatus can result in requiring multiple trips into the wellbore for discharging multiple fluids at one or more locations in the wellbore. Therefore, it is desirable to have apparatus and methods for discharging multiple fluids downhole.

SUMMARY OF THE DISCLOSURE

The disclosure herein provides an apparatus and methods for discharging multiple fluids into a wellbore. In one aspect, a method may include: conveying a carrier in the wellbore, the carrier including at least a first chamber and a second chamber separated by a moving barrier therebetween; draining a first fluid from the first chamber to cause the barrier to move toward the first chamber; draining a second fluid from the second chamber by opening a flow passage associated with the moving barrier by a member associated with the first chamber.

In another aspect, an apparatus made according to the disclosure may include: a first chamber having a first flow control device to drain a first fluid from the first chamber; a second chamber having a second flow control device associated therewith, wherein a member associated with the first chamber actuates the second flow control device when the second fluid control device moves toward the first flow control device to drain a second fluid from the second chamber.

Examples of the more important features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the disclosure, references should be made to the following detailed description of the drawings, taken in conjunction with the accompanying drawings, in which like elements in general have been given like numerals, wherein.

DETAILED DESCRIPTION OF THE DRAWINGS

Figure 1:
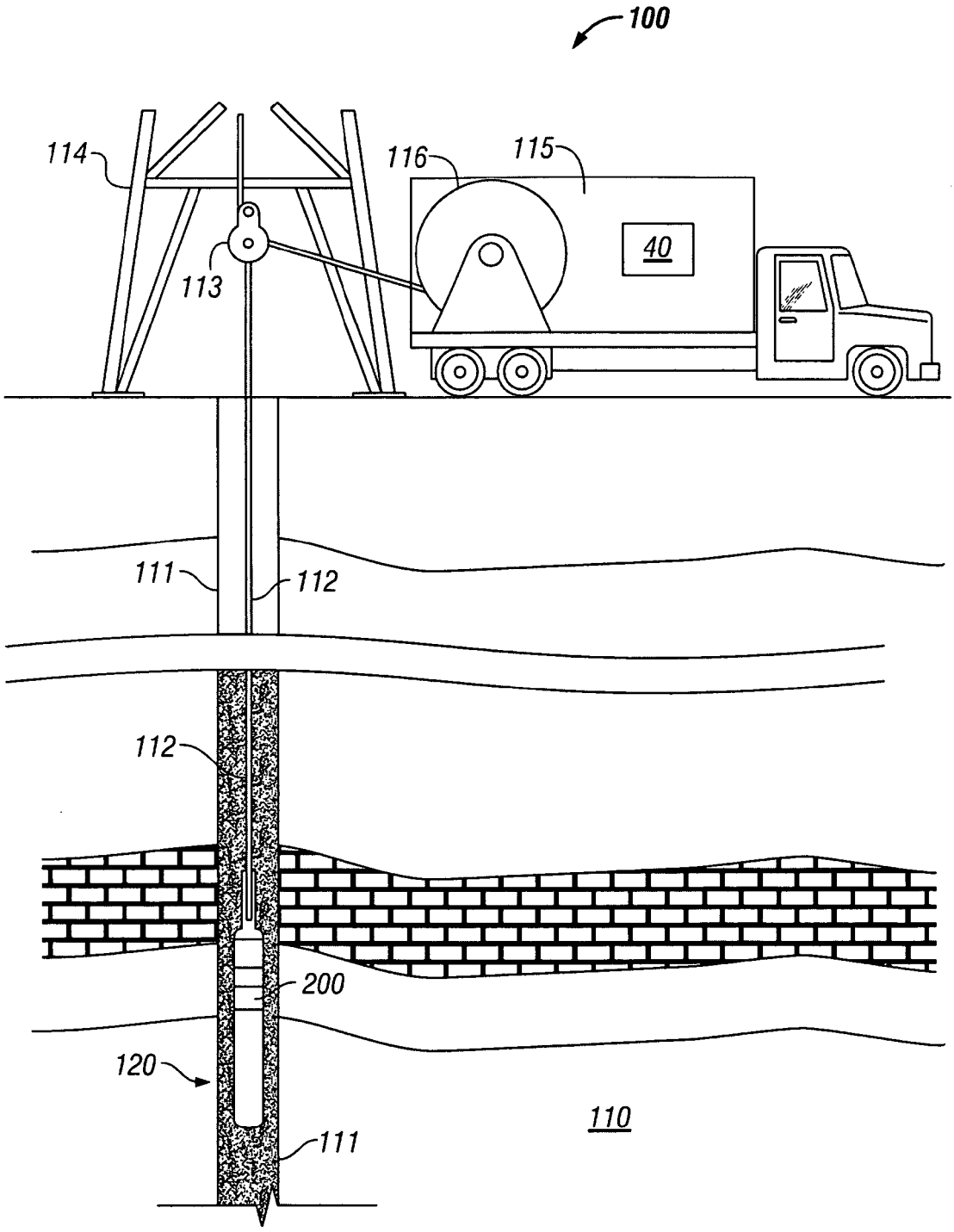
FIG. 1 is a schematic illustration showing a tool made according to one embodiment of the disclosure conveyed into a wellbore for discharging multiple fluids in the wellbore.

FIG. 1 is a schematic showing a system 100 for discharging multiple fluids at one or more locations in a wellbore 111 formed in an earth formation 110. The system, in one aspect, shows a tool 200 made according to one embodiment of the disclosure herein conveyed in the wellbore 111. The tool 200 may be conveyed alone or as part of a tool string 120 by a suitable conveying member 112, such as a wireline or tubing. The tool 200 is conveyed from a surface rig 114 using a winch 116 placed on a truck 115 and a pulley 113 placed on the rig 114. A tubing-conveyed system generally includes an injector for conveying the tubing and the tool 200 in the wellbore 111. Offshore systems include a wireline unit or an injector stationed on the offshore rig. Power to the tool 200 and data communication between the tool 200 and the surface unit 115 is provided via suitable conductors in the conveying member 112. The surface unit 115 includes a control unit or controller 40, which may be a computer-based system, for controlling the operations of the tool 200. Controller 115 further includes: data storage devices, such as magnetic tapes, solid state memory, etc.; data input devices; display devices; and other circuitry for controlling and processing data received from the tool 200. To discharge the multiple fluids in the wellbore, the tool 200 is conveyed to a selected location, where one or more fluids, as desired, are discharged at such location. The tool may then be moved to other locations to discharge the remaining fluids at such locations. In this manner the tool 200 may be utilized to discharge multiple fluids in the wellbore or another tool for deployment during a single trip in the wellbore as more fully described in reference to FIGS. 2 and 3.

Figure 2:
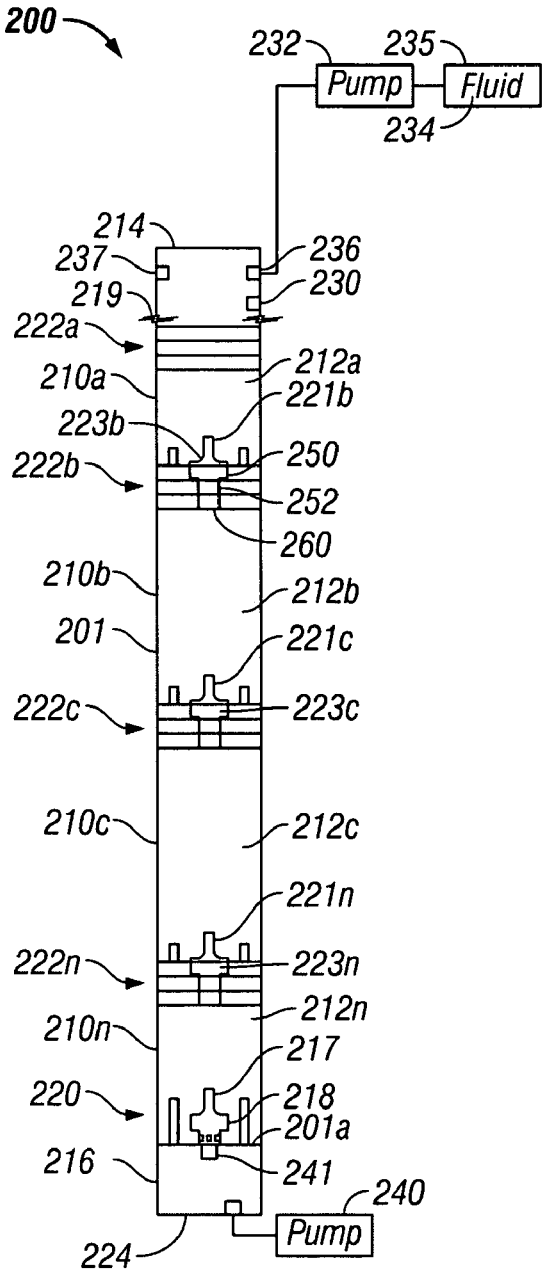
FIG. 2 is a schematic illustration of the tool shown in FIG. 1 showing multiple fluid chambers for holding fluids to be discharged in the wellbore.

FIG. 2 shows an embodiment of the downhole tool 200 configured to discharge multiple fluids downhole. The tool 200 includes a carrier or tool body 201 that contains a number of fluid chambers, such as chambers 210*a*, 210*b*, 210*c* and 210*n*, wherein each chamber is adapted to respectively hold therein fluids 212*a*, 212*b*, 212*c* and 212*n*. The fluids in these chambers may be the same or different. The size and number of chambers carried by a carrier are chosen based on suitable design criteria. The tool 200 may further include a pressure equalizer sub 214 (also referred to herein as the "pressure chamber" or "top section") to equalize pressure, as explained in more detail below. The top section 214 may be attached to the top of the carrier 201 by any suitable mechanism, including but not limited to threads 219. A floating barrier, such as piston 222*a* (also referred to herein as the "top barrier" or "top piston") separates the fluid chamber 210*a* from the top section 214. The top piston 222*a*, in one aspect, may be a solid piston that does not permit fluid to pass from the top section 214 into chamber 210*a*. A suitable stopping mechanism, such as a mechanical stop 230, may be provided in the carrier 201 to prevent the piston 222*a* from moving beyond the mechanical stop 230.

A flow-through sub 220 may be provided at the bottom of the carrier 201 to form the last chamber 210*n* in the carrier. The flow-through sub 220 may be affixed at or proximate the bottom end 201*a* of the carrier 201. The flow-through sub 220 may further include a flow device 218 that enables the fluid 212*n* to drain out from the chamber 210*n*. The flow device 218 may be any suitable device, including but not limited to a pop-up valve, flow-through opening, an electrically-operated valve, or a pump. The flow-through sub 220 may further include an actuating member 217, such as a nipple or pin configured to open a valve 223*n* in the piston 222*n* associated with chamber 210*c*, i.e., the chamber above the last chamber 210*n*, as explained in more detail below.

Still referring to FIG. 2, any number of intermediate chambers, such as chambers 210*b* and 210*c* may be formed between the top chamber 210*a* and the bottom chamber 210*n*, each such chamber being separated from the adjoining chamber by a separate floating barrier, such as a floating piston. For example, fluid chambers 210*a* and 210*b* may be separated by a floating piston 222*b*, fluid chambers 210*b* and 210*c* by a floating piston 222*c*, etc. Also, the pistons 222*b* and 222*c* respectively may include flow-through devices 223*b* and 223*c* that further may include actuating members 221*b* and 221*c* respectively. The actuating member may be any suitable device, including but not limited to a protruding member, such as a nail or nipple. Therefore, in the configuration shown in FIG. 2, any number of fluid chambers may be linearly formed in the carrier 201. Additional carriers may be attached to the carrier 201 to extend the tool 200 length to carry additional fluid chambers. Also, carriers of different sizes may be attached to each other using any suitable mechanism.

Still referring to FIG. 2, the tool 200 may further include a device 232 that is configured to selectively apply pressure on top of the floating piston 222*a*. The device 232 may be a pump that is configured to pump a suitable fluid 234 under pressure into the upper section 214. The fluid 234 may be the wellbore fluid or another fluid, such as oil, stored in a storage tank 235. A valve 236 may be provided between the top section 214 and the pump 232 to control the flow of the fluid 234 into the top section 214. By controlling the pump 232, the pressure applied on the piston 222*a* may be controlled. In another aspect, a flow device 237, such as a valve, may be provided to expose the top section 214 to the wellbore fluid so as to apply the hydrostatic pressure on the top piston 222*a*. Yet, in another aspect, a gas (such as nitrogen or another inert gas) stored under pressure (not shown) may be discharged into the top section 214 to apply pressure on the top piston 222*a*. In this manner the pressure at the top piston 222*a* may be equalized or create a positive differential during the operation of the tool downhole.

The tool 200 may further include a bottom section 216 below the last chamber 210*n* to drain the fluid 212*n* from chamber 210*n* and/or discharge the fluid received from chamber 210*n* into the wellbore, another location in the wellbore or the tool in the wellbore. In one aspect, the bottom section 216 may include a chamber 224 for receiving fluid from the bottom chamber 210*n*. A pump 240 associated with the bottom section 216 may be utilized to pump fluid from the chamber 224 into the wellbore or to another device or location in the wellbore. Alternatively, the flow-through sub 220 may include a flow device 241 configured to be activated to drain fluid from chamber 210*n*. The flow device 241 may be an electronically-operated valve, a mechanical valve (such as a pressure valve) that may be operated by applying sufficient pressure on the fluid 212*n* from the chamber 241, or any other suitable flow device. Each piston 222*b*-222*c* and the flow-through sub 220 may include a suitable actuating member or an actuating device, such as a nipple 221*b*-221*n* to initiate the discharge or draining of the fluid from the fluid chamber above it, as explained in more detail in reference to FIG. 3.

Figure 3:
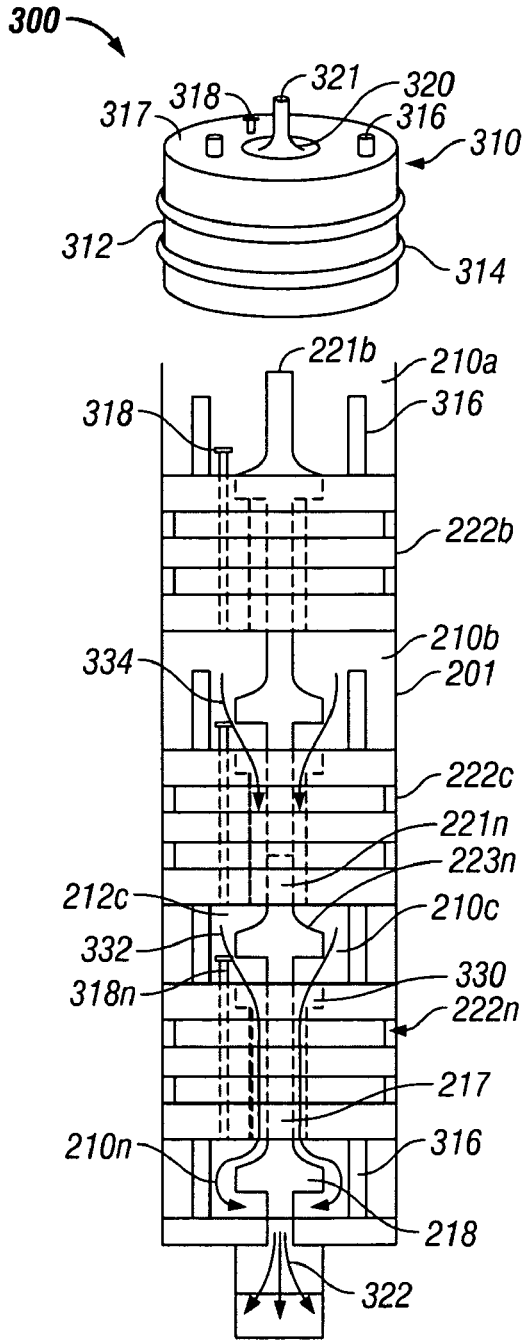
FIG. 3 is a schematic diagram showing the tool of FIG. 2 during operation of the tool to discharge the fluids in the wellbore or into another tool.

FIG. 3 shows an exploded view 300 of a floating piston and the manner in which fluids from chambers 210*a*-210*n* are drained during a typical operation of the tool 200. FIG. 3 shows an exemplary floating piston 310 having a piston body 312. One or more sealing elements 314 are placed on an outer surface of the piston body 312 to provide a seal between the piston and the inside of the carrier body 201. When the piston 310 is placed inside the carrier, the piston can move in both directions and the sealing elements 314 seal the chambers above and below the piston 310. The piston 310 may include a valve, such as a pop-up valve 320, in the piston body. The valve 320 has a seat 250 (see FIG. 2) inside the piston body and an extension 252 (see FIG. 2) that may be pushed to open the valve 320. A nipple member 321 is configured to be inserted in an opening 260 (see FIG. 2) in the piston to open the valve 320. The piston 310 may include one or more protruding elements 316 (also referred to herein as "shoulders") that extend from the piston body upper surface 317 to stop a piston above it from moving further toward the piston 310. A loading valve 318 may be provided through which a chamber below the piston 310 may be loaded with the desired fluid. The loading valve 318 also may act as an air bypass. The piston 310 also may include one or more fluid flow passages 330 that allow the fluid from one chamber to flow into the chamber below it when the pop-up valve 320 associated therewith is opened.

Referring to FIGS. 2 and 3, in operation, individual fluid chambers such as 210*a*-210*n* are filled with selected fluids at the surface. In one aspect, each valves 221*a*-221*n* may include a suitable mechanism, including, but not limited to, a ball detent, to temporarily hold its corresponding valve in a closed position until it is activated by an actuating member. The tool 200 is then conveyed alone or as a part of a tool string to a selected depth in the wellbore. The fluid 212*n* from the bottom chamber 210*n* is drained at a selected rate. When a valve, such as valve 218, is provided, the flow rate may be controlled by controlling the valve. When a pump 240 or another device is provided, the flow rate may be controlled by the pump or such other device as shown by arrows 322. The fluid 212*n* may be discharged into the wellbore, another suitable location or a downhole tool by using the pump 240. As the fluid 212*n* drains out from the chamber 210*n*, the piston 222*n* associated with the fluid chamber 210*c* starts to slide down toward the valve 218. The pin member 217 of the valve 218 pushes the valve 223*n* upward, thereby opening the valve 223*n* to allow the fluid 212*c* to drain out from the chamber 210*c* and into the chamber 210*n* via the passages 330 in the piston 223*n*, as shown by arrows 332. The fluid 212*c* then drains out of the tool 200 via the chamber 210*n* as shown by arrows 322. The loading valve 318*n* aids air to bypass the valve 223*n* during flow of the fluid. The piston 222*n* will continue to move downward until it rests on the shoulders 316. The movement of the piston 222*n* may be stopped at any time by closing the valve 218 or stopping the pump 240. As the fluid drains from the chambers 210*n* and 210*c*, the piston 222*c* moves toward the piston 222*n*. The pin member 221*n* of piston 222*n* will then open the valve 223*c* to drain the fluid 212*b* from chamber 210*b* out of the tool via the fluid passages 334, 332 and 322. The above process continues until the fluid from all the chambers is drained. The tool 200, therefore, may carry multiple fluids, wherein a first fluid may be discharged at a first downhole location, a second fluid may be discharged at the first location or a second location, and a third fluid may be discharged at any of the first and second locations or at a third location, etc.

Therefore, the apparatus shown in FIGS. 1-3, in general, may include a hollow carrier body that may include attachment mechanisms on each end, such as threads—male threads on one end and female threads on the other end. Carriers may be joined or attached together to increase the overall length of the apparatus and thus the total fluid-carrying capacity. Pistons may be placed to separate the fluids in successive fluid chambers. Each piston may include a pop-up valve with an actuating or initiating member (such as a nipple). As the fluid from the bottom chamber is drained, the initiating nipple associated with the bottom chamber will push open the pop-up valve of the piston associated with the fluid chamber above it. This piston will continue to move until it comes to rest on a shoulder mount associated with the bottom valve. Thus, the fluid from the second fluid chamber will drain until the piston comes to a rest. The nipple associated with the second chamber will then start opening the pop-up valve of the third chamber and so on.

Thus, in view of the disclosure herein, an apparatus for discharging multiple fluids downhole made according to one embodiment of the disclosure herein may include: a first chamber configured to contain a first fluid; a second chamber configured to contain a second fluid; a movable barrier separating the first chamber and the second chamber; and an actuating member configured to drain the second fluid from the second chamber when the first fluid is drained from the first chamber. The apparatus may further include a device or unit to equalize pressure on the barrier. The apparatus may further include a device that drains the fluid from the first chamber. In another aspect, a device may be provided that discharges the fluid drained from the first chamber into a suitable location downhole, including the wellbore and a tool downhole.

In another aspect, an apparatus made according to another embodiment of this disclosure may include: a first chamber; a first flow device for draining a first fluid out from the first chamber; a second chamber; a second flow device between the first chamber and the second chamber; and an actuating member that is configured to actuate the second flow control device to drain a second fluid out from the second chamber when the first fluid is drained from the first chamber. The actuating member may be a nipple. A carrier or housing may be used to carry the first and second chambers. In one aspect, the first flow device may be fixed at the bottom end of the carrier while the second flow device may be placed inside the carrier so that the second flow device moves within the chamber toward the first flow device when the first fluid is drained out from the first chamber. The actuating member may be configured to actuate a valve of the second flow device to drain the second fluid out from the second chamber and into the first chamber. In another aspect, the apparatus may further include a loading device suitable for loading fluids into the first and second chambers. The loading device may be one-way loading valve integral to the second flow device for loading a fluid into the first chamber. Additional chambers may be provided uphole of the second chamber, each such chamber separated by a flow device that may further include a loading valve for loading the chamber below or downhole of the valve.

In another aspect, the apparatus also may include a pressure equalizer configured to apply pressure on the top barrier in the apparatus. Yet, in another aspect, the apparatus may further include a device to apply pressure on the top barrier that is selected from one of: (i) a pump to pump a fluid under pressure in a pressure chamber; (ii) an opening in the pressure chamber that exposes the pressure chamber to a hydrostatic pressure when the apparatus is in the wellbore; and (iii) a gas unit that injects a gas under pressure into the pressure chamber. In another aspect, the apparatus may further include a device that opens and closes the first flow device to allow the fluid from the first chamber to drain out from the first chamber. In another aspect, the apparatus may further include at least one additional chamber above the second chamber that is separated from the second chamber by a third flow device having a valve that is configured to be opened by an actuating member of the second flow device.

In another aspect, a method for discharging a plurality of fluids downhole according to one aspect disclosed herein may include: conveying a fluid carrier in a wellbore, the fluid carrier including a first chamber and a second chamber, each chamber having an associated flow device; draining a first fluid from the first chamber to cause the second chamber to move within the carrier so that an actuating device associated with the first chamber actuates the flow device of the second chamber to drain a second fluid from the second chamber. The method may further include equalizing pressure on the second chamber before or after conveying the carrier in the wellbore. Draining the fluid from the first carrier may include actuating the flow device associated with the first chamber by one of: (i) an electric motor; and (ii) a pump. In another aspect, the carrier may include additional chambers, wherein the chambers are separated from each other by a movable barrier therebetween. The method may further include providing a loading valve that allows air to bypass the valve associated with second chamber.

The foregoing disclosure is directed to certain embodiments of the disclosure. Various modifications will be apparent to those skilled in the art. It is intended that all variations of the disclosed embodiments and modification thereto that fall within the scope of any claims of this application be embraced by the foregoing disclosure.

What is claimed is:

1. An apparatus for use in a wellbore, comprising:

a carrier;

a first chamber in the carrier configured to contain a first fluid;

a second chamber in the carrier configured to contain a second fluid;

a movable barrier separating the first fluid in the first chamber from the second fluid in the second chamber; and an actuating member configured to initiate draining of the second fluid from the second chamber when the first fluid is drained from the first chamber to bring the actuating member into contact with the movable barrier.

2. The apparatus of claim 1, wherein the movable barrier is a floating piston that includes a fluid flow device that is actuated by the actuating member.

3. The apparatus of claim 2, wherein the fluid flow device includes a movable member configured to be actuated by the actuating member.

4. The apparatus of claim 1 further comprising a pump or a fluid flow device configured to drain the first fluid from the first chamber.

5. The apparatus of claim 1 further comprising a pressure equalizer configured to apply pressure on the movable barrier.

6. The apparatus of claim 5, wherein the pressure equalizer comprises one of: a pressure chamber in pressure communication with the movable barrier; and a pressure device configured to supply a fluid under pressure to a pressure chamber.

7. The apparatus of claim 5, wherein the pressure equalizer includes a one of: a pump configured to pump a fluid under pressure into a pressure chamber; a device configured to discharge a gas under pressure into a pressure chamber; and a fluid flow device that in one position exposes the movable barrier to a wellbore pressure.

8. The apparatus of claim 1 further comprising at least one additional chamber that is separated from the second chamber by a second movable barrier that includes a fluid flow device having a valve for draining fluid from the one additional chamber.

9. The apparatus of claim 1, wherein the movable barrier includes an air bypass.

10. The apparatus of claim 8 further comprising a stop device that prevents the second movable barrier to move beyond a selected location in the carrier.

11. A method of discharging a plurality of fluids in a wellbore, comprising:

conveying a carrier in the wellbore that includes a first chamber having a first fluid and a second chamber having a second fluid, wherein the first and second chambers are separated by a movable barrier; and draining the first fluid from the first chamber to cause the movable barrier to move into contact with an actuating device to initiate draining of the second fluid from the second chamber.

12. The method of claim 11, wherein draining the first fluid comprises pumping the first fluid out from the first chamber.

13. The method of claim 12 further comprising draining the first fluid into one of:

the wellbore; and into a chamber in the carrier.

14. The method of claim 11 further comprising applying pressure on the movable barrier while draining the first fluid from the first chamber to cause the movable barrier to move toward the actuating member.

15. The method of claim 14, wherein applying pressure on the movable barrier comprises supplying a fluid under pressure to a chamber in pressure communication with the movable barrier.

16. The method of claim 11, wherein draining the second fluid from the second chamber comprises causing a member in the actuating device to actuate a fluid flow device in the movable barrier.

17. The method of claim 11 further comprising draining the first fluid from the first chamber at a first location in the wellbore and draining the second fluid from the second chamber at a second location spaced from the first location without retrieving the carrier from the wellbore.

18. An apparatus for supplying a plurality of fluids into a wellbore, comprising:

a downhole tool conveyable into a wellbore by a conveying member, the downhole tool including:

a carrier;

a first chamber in the carrier configured to contain a first fluid;

a second chamber in the carrier configured to contain a second fluid;

a movable barrier separating the first fluid in the first chamber from the second fluid in the second chamber;

an actuating member configured to drain the second fluid from the second chamber when the first fluid is drained from the first chamber to bring the actuating member into contact with the movable barrier; and a pressure equalizer configured to apply pressure on the movable barrier to cause the barrier to move toward the actuating member.

19. The system of claim 18 further comprising a controller configured to control one of: draining the first fluid from the first chamber; supplying a fluid into a chamber associated with the pressure equalizer.

20. The apparatus of claim 18, wherein the movable barrier is a floating piston having a fluid flow device configured to be actuated by the actuating member.

* * * * *